US007067745B2

(12) United States Patent
Holt

(10) Patent No.: US 7,067,745 B2
(45) Date of Patent: Jun. 27, 2006

(54) SAFETY SWITCH ASSEMBLY

(75) Inventor: David Holt, Tyldesley Manchester (GB)

(73) Assignee: Eja Limited, Wigan (GB)

( * ) Notice: Subject to any disclaimer, the term of this patent is extended or adjusted under 35 U.S.C. 154(b) by 0 days.

(21) Appl. No.: 11/095,781

(22) Filed: Mar. 31, 2005

(65) Prior Publication Data

US 2005/0252751 A1 Nov. 17, 2005

(30) Foreign Application Priority Data

Apr. 1, 2004 (GB) ..... 0407440.7

(51) Int. Cl.
*H01H 19/58* (2006.01)

(52) U.S. Cl. ..... 200/11 R; 200/17 R

(58) Field of Classification Search ..... 200/329–334, 200/11 R, 17 R, 43.01, 43.04–43.09, 61.62–61.68
See application file for complete search history.

(56) References Cited

U.S. PATENT DOCUMENTS 3,163,730 A 12/1964 Drage
5,072,078 A * 12/1991 Rao et al. ..... 200/11 R
5,422,448 A * 6/1995 Nakano et al. ..... 200/11 DA
6,013,881 A 1/2000 Hall et al.
6,365,850 B1 4/2002 Arnold et al.
6,720,504 B1 * 4/2004 Nishimoto et al. ..... 200/4

FOREIGN PATENT DOCUMENTS

JP 07-035294 7/1993
WO WO 90/08296 7/1990

* cited by examiner

*Primary Examiner*—Michael Friedhofer
*Assistant Examiner*—Lisa Klaus
(74) *Attorney, Agent, or Firm*—Quarles & Brady, LLP; William R. Walbrun

(57) ABSTRACT

A rotary safety switch assembly is disclosed in which electrical contacts are movable from a power supply OFF position to a power supply ON position by movement of a rotary member contained within a housing, the electrical contacts comprising first stationary contacts and second movable contacts, and in which the first stationary contacts are carried by a housing part and the second movable contacts are carried by the rotary member and are movable therewith in an arc about said predetermined axis to make and break contact with the first stationary contacts in response to movement of the rotary member by the actuator.

36 Claims, 3 Drawing Sheets

FIG. 2
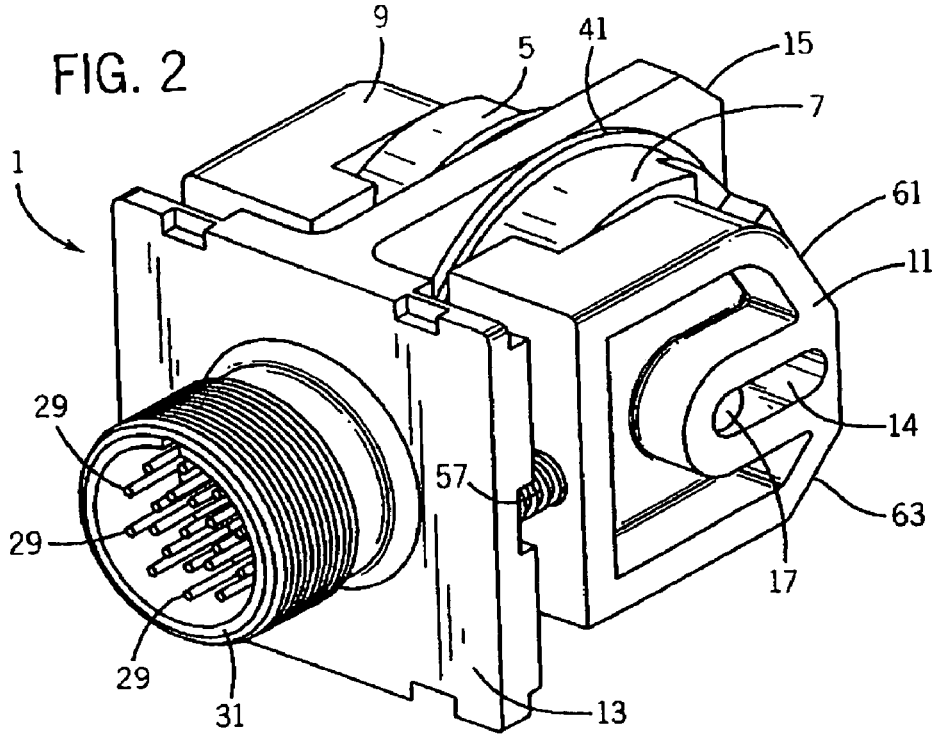
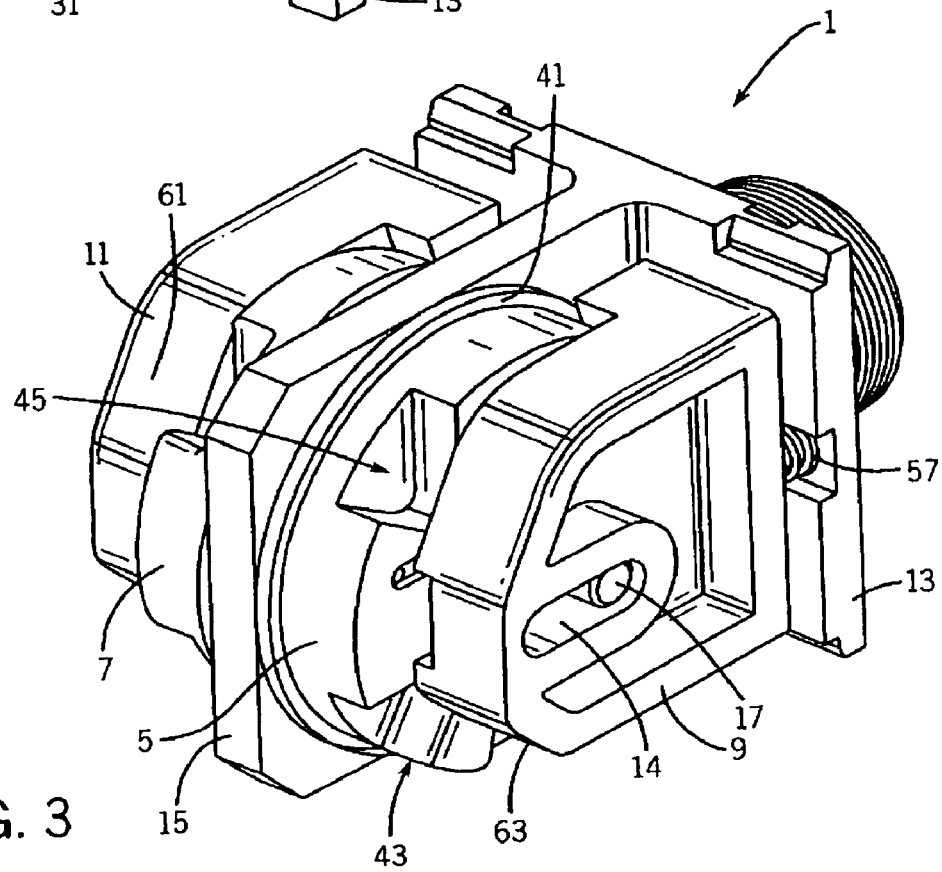
FIG. 3

SAFETY SWITCH ASSEMBLY

TECHNICAL FIELD

The present invention relates to a safety switch assembly used especially, but not exclusively, in machinery guards enclosing kinetic machinery.

DESCRIPTION OF THE BACKGROUND ART

A known safety switch assembly comprises a safety switch adapted to be fitted to an enclosure and an actuator adapted to be fitted to a door, gate or protective cover of the enclosure and insertable into the safety switch to turn ON the electrical power supply when the enclosure is closed by the door, gate or protective cover. The known safety switch comprises within a housing normally-open contacts, one set fixed and the other movable and carried by an axially movable push rod spring-loaded to maintain the sets of contacts apart and the power supply consequently OFF.

The axially movable push rod is connected to a rotatable cam which is operable by the actuator to cause cam rotation and axial movement of the push rod to a power supply ON position. The cam may be provided with means to prevent rotation unless rotation is initiated by a correctly configured actuator.

The requirement for axial movement of the contact carrier necessarily increases the overall length of the device and there can be loss of free axial movement due to the build up of dirt and grease which may inhibit axial displacement. It is therefore an objective of the invention to provide an improved switch assembly.

SUMMARY OF THE INVENTION

Accordingly, the present invention provides a safety switch assembly comprising a housing containing electrical contacts movable from a power supply OFF position to a power supply ON position by movement of a rotary member contained within the housing and adapted to be rotated about a predetermined axis by an actuator insertable into the housing, the electrical contacts comprising first stationary contacts and second movable contacts, and wherein the first stationary contacts are carried by a housing part and the second movable contacts are carried by the rotary member and are movable therewith in an arc about said predetermined axis to make and break contact with the first stationary contacts in response to movement of the rotary member by the actuator.

The housing part forms part of a housing body. There may be a plurality of first and second contact sets. Each set may comprise a pair of first contacts and at least one second contact. The second contact forms a conduction path or bridge between the pair of first contacts in the power ON position. The first contacts connect with electrical terminals by way of conduction paths. The terminals may be configured to accept wire connections. More preferably they may take the form of electrical connection pins to receive a mating socket or vice versa. Where a plurality of first contacts are provided, the corresponding plurality of pins take the form of a plug which receives a correspondingly configured socket. Alternatively the terminals may comprise sockets that receive a correspondingly configured plug.

The first contacts may be disposed concentrically to one side of the housing part. Preferably the housing part comprises a web or flange and preferably there are first contacts disposed to both sides of said web and the rotary member comprises two parts disposed to opposite sides of said web and presenting second contacts to make and break engagement with said first contacts. The pairs of first contacts may be spaced radially or circumferentially. Conveniently they are spaced diametrically opposite one another on a common pitch circle diameter. Where a rotary member is provided to both sides of the web, they may comprise two separately rotatable rotary members or two members that are tied together to rotate together.

More preferably the first contacts comprise conduction paths that are integrated into the material of the housing part that is made of a non-conductive material, such as plastics. The conduction paths lead between exposed contact areas and the aforesaid terminal provisions. They may take the form of a surface mounted PCB or utilise embedded conductors between said positions. The preferred construction utilizes so called 'hard wired conduction paths' which avoid the need for soldered connections.

More particularly, the second contacts comprise contact elements that are biased towards the first contacts. The contact elements may comprise strips of conductive material that exhibits resilience. They may be arranged as spring leaves or cantilevered strips to ensure good contact with the first contact areas in the make position. Alternatively, the rotary member or members and hence the second contacts carried thereby may be resiliently biased towards the first contacts. Exceptionally the first contact areas may be resiliently connected to the associated conductor paths.

Preferably the housing has at least one aperture to receive the aforesaid actuator for the rotary member, and the rotary member preferably has at least one reception location in which an end of the actuator engages to rotate the rotary member in response to rectilinear movement of the actuator. More preferably, the housing has two apertures that are disposed perpendicularly to one another and the rotary member is provided with reception locations to permit rotation thereof on entry of the actuator through either one of the apertures. Preferably the apertures are formed in a housing cap that attaches to the housing body. The apertures are disposed offset from the axis of rotation of the rotary member and the housing cap may be attached to the housing body in alternative orientations to create a further two positions in which the actuator can be inserted relative to the rotary member, and the rotary member has reception locations to accept the actuator in said alternative positions.

More preferably still the housing accommodates at least one locking member which is movable between a first position in which rotation of the rotary member is prevented and a second position in which rotation is permitted. Where the rotary member comprise two members disposed to opposite sides of said web it is preferred to have a respective locking member for each one. The locking member is preferably urged into locking engagement with the rotary member by resilient biasing means. The locking member may comprise a lug that is received in a recess of the rotary member in the locking position. More particularly the actuator is configured to displace the locking member or members from the locking position on insertion of the actuator in to the aperture therefor. The locking member may be slidably or pivotably movable.

The rotary member or members are preferably rotatable against resilient biasing which acts to return the rotary member to a first position, usually corresponding to a power OFF position, when the actuator is removed. Preferably the rotary member or members are urged into sealing contact with the web to seal the electrical contacts from the external environment.

BRIEF DESCRIPTION OF THE DRAWINGS

The present invention will now be described further hereinafter, by way of example only, with reference to the accompanying drawings; in which:

FIG. 2 is a perspective view of the switch assembly of FIG. 1 from one side and above when assembled but omitting the housing cap, FIG. 3 is a perspective view of the switch assembly of FIG. 2 from the other side and above.

DESCRIPTION OF A PREFERRED EMBODIMENT

Figure 4:
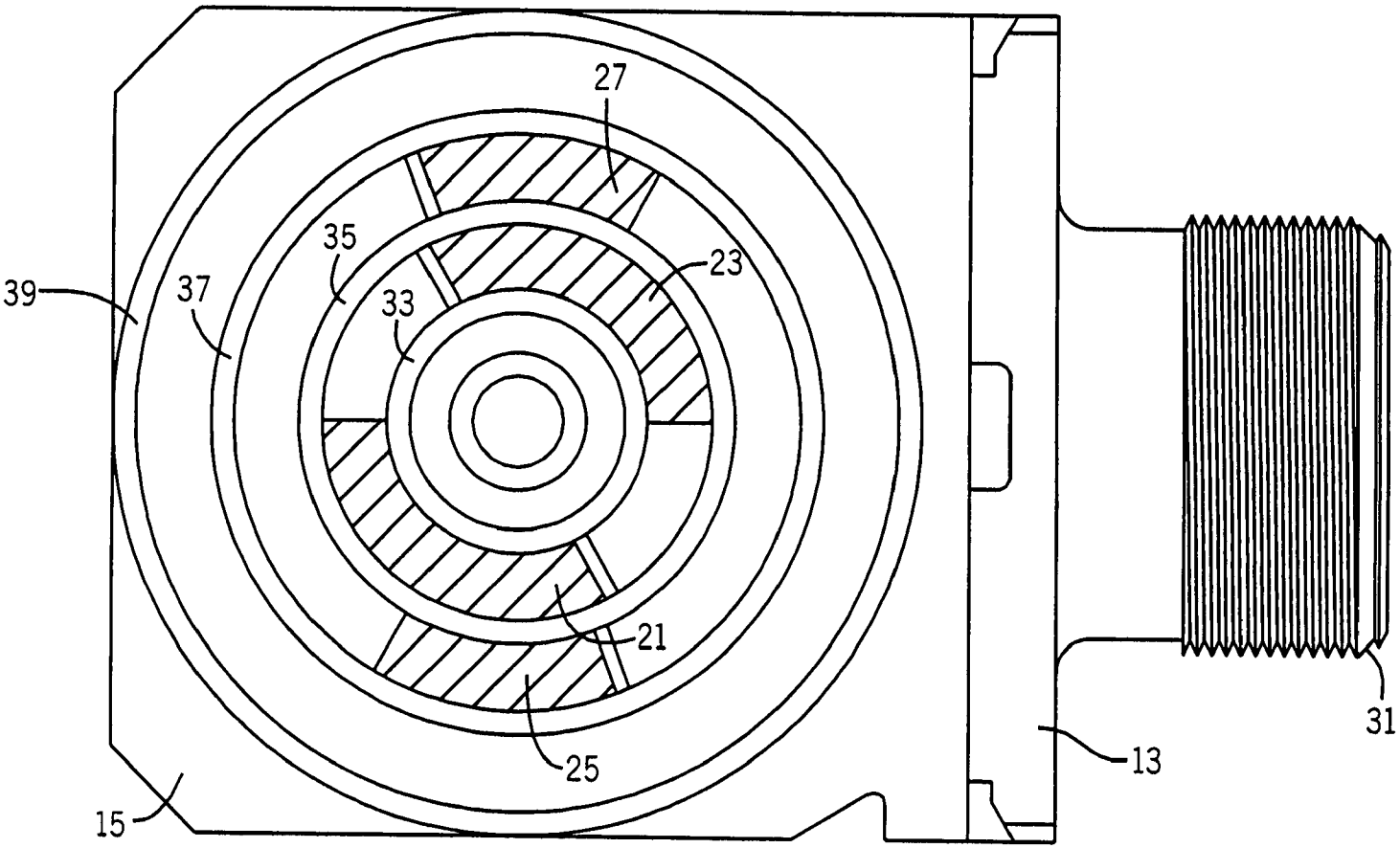
FIG. 4 is a side view of the housing body shown in FIG. 1 to a larger scale.

Referring now to the drawings, a switch assembly comprises a housing body part 1, a housing cap 3, a pair of rotary members 5,7 and a pair of locking members 9,11. The housing body part 1 is generally T-shaped in the illustrated embodiment, having a base 13 and a flange or web 15 disposed perpendicularly with respect to the base. The web receives an axle 17 that projects from opposite sides thereof and on which a respective one of the rotary members 5,7 are received to be disposed at opposite sides of said web. The web incorporates a plurality of electrical contacts. In the illustrated embodiment there are four contacts to either side of the web and the exposed areas thereof are shown at 21, 23, 25, and 27 in FIG. 4. It will be seen that the contact areas are arcuate. They may have the same contact areas or different contact areas as shown in the embodiment of FIG. 4. Contact areas 21, 23 are disposed on the same pitch circle diameter and diametrically opposite one another, and contact areas 25, 27 share a common pitch circle diameter but different to that of contact areas 21, 23. They are also diametrically opposite one another. The contact areas are part of respective conductors (not shown) that terminate in at least one respective terminal connection. The terminal connection comprises at least one respective pin 29 in the illustrated embodiment. Thus there will be a minimum of eight pins for the illustrated embodiment. In practice there may be more than one pin for each conductor. The conductors are embedded into the material of the housing body which is made of a non-conducting material. The pins 29 are grouped together within a threaded collar 31. A mating plug/socket (not shown) facilitates electrical connection of the switch assembly into its associated electrical circuit.

Figure 1:
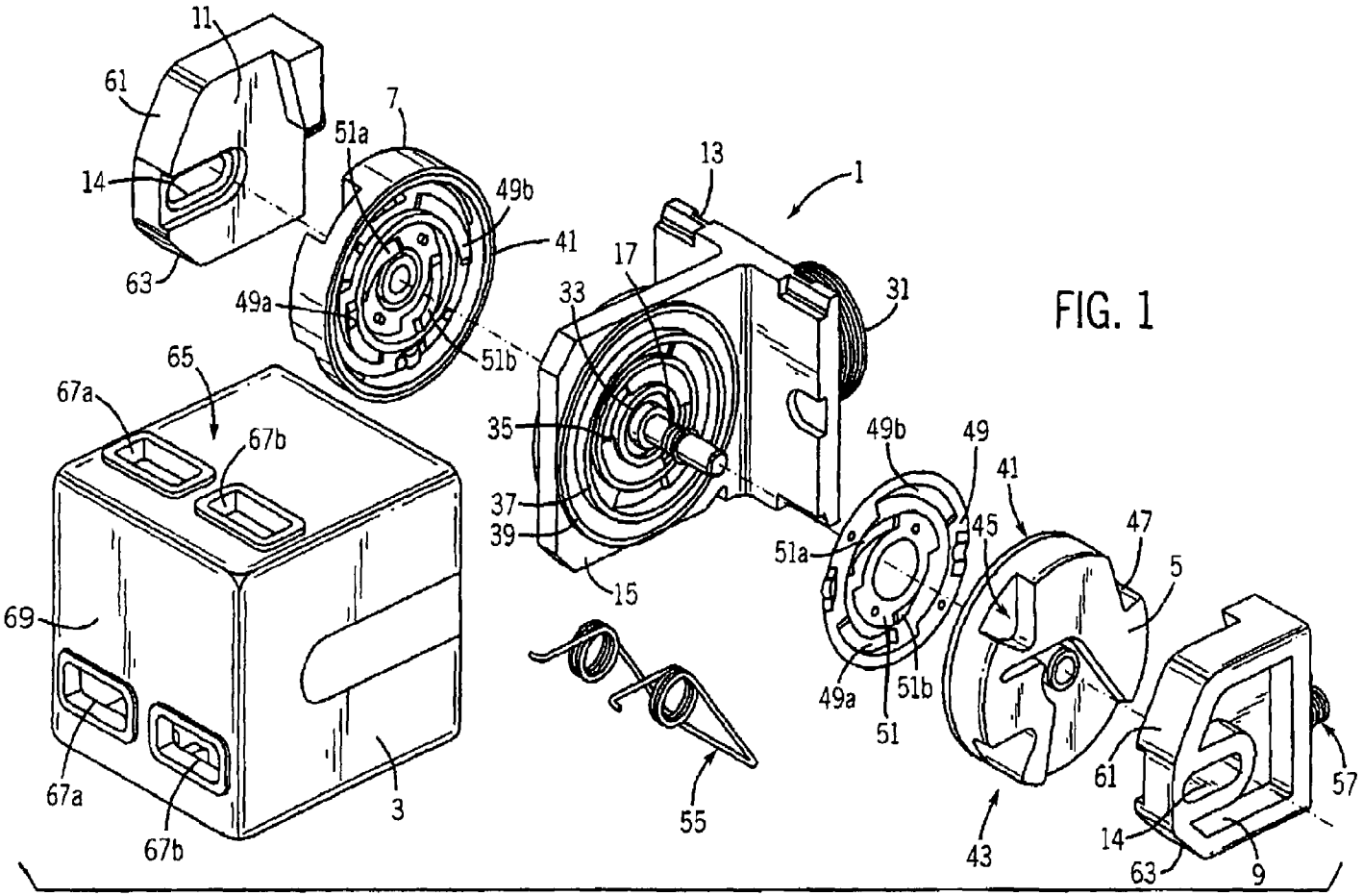
FIG. 1 is an exploded perspective view of a switch assembly according to the invention.

It will be noted from FIG. 1 that the web is provided with raised concentric wall elements 33, 35, 37, 39. There are corresponding raised wall elements to both sides of the web. The contact areas 21,23 are disposed between wall elements 33, 35 and contact areas 25, 27 are disposed between wall elements 35, 37. Wall elements 37,39 provide a track that receives a peripheral sealing element 41 of the rotary member 5. The rotary member 7 has a corresponding peripheral sealing element 41 that is received in a corresponding track to the other side of the web. The following description of the rotary member 5 applies equally to rotary member 7. Rotary member 5 is generally cup-shaped and has two reception locations 43, 45, and a recess 47 in its outer periphery the function of which will be described further hereinafter. The rotary member has two contact members 49,51 secured thereto for rotary movement therewith. Member 49 is disposed concentrically with respect to member 51. Each member has two contact elements 49*a*, 49*b*; 51*a*, 51*b* that depend cantilever like from the annular body of the respective contact members. The contact elements exhibit some resilience. The rotary members 5,7 are acted on by a wire from spring 55 to urge them to a rest position.

The locking members 9,11 fit on to the opposite ends of the axle and have a slot 14 that allows them to move rectilinearly relative to the axis of the axle as described further hereinafter. Movement is against a respective spring 57 that acts between the housing body and the respective locking member 5,7. The locking member is generally rectangular but has chamfered corners 61,63 the function of which will be described further hereinafter. A face of the locking member facing the rotary member carries a lug 64 which is configured to be received in recess 47 of the rotary member in its rest position.

The housing cap 3 comprises a hollow cube with one open side. It is dimensioned to fit over the rotary member and the web and to connect with the body part. A side 65 has at least one aperture to receive an actuator (not illustrated) for the rotary member. The apertures may comprise one slot or two slots 67*a*,67*b* as shown in the illustration. Another side 69 has corresponding apertures.

In use the switch assembly described herein is secured to an enclosure typically for kinetic machinery and an actuator (not illustrated) is fitted to a door, gate or protective cover of the enclosure. The housing cap 3 is fitted to the enclosure in a suitable orientation to receive the actuator. The actuator is specially shaped to allow it to be inserted in to the apertures 67*a*,67*b* in one side of the cap, and on insertion its end cooperates with one of the chamfers 61,63 of the locking members 9,11 to displace them and free lug 64 from recess 47 in the rotary members 5,7 so that continued insertion gives rise to rotation of the rotary members. As the rotary members rotate the contact elements 49*a*,49*b*;51*a*,51*b* move along a track between the raised wall elements from a contacts broken (power OFF) position to a contacts made (power On) position when the two movable contact elements 49*a*,49*b*;51*a*,51*b* engage with respective pairs of the fixed contacts 25,27;21,23. On removal of the actuator the rotary members rotate in the opposite direction under the influence of the spring 55 and the locking members 9,11 are urged back in to the locking position.

Incorporating the fixed contacts into the body and providing the movable contacts on the rotary member to rotate therewith gives rise to a particularly compact construction.

The invention claimed is:

1. A safety switch assembly comprising:

a housing containing electrical contacts movable from a power supply OFF position to a power supply ON position by movement of a rotary member contained within the housing and configured to rotated about a predetermined axis by an actuator insertable into the housing, wherein the electrical contacts comprise first stationary contacts and second movable contacts, and wherein the first stationary contacts are carried by a housing part and the second movable contacts are carried by the rotary member and are movable therewith in an arc about said predetermined axis to make and break contact with the first stationary contacts in response to movement of the rotary member by the actuator.

2. A safety switch assembly as claimed in claim 1 in which the housing part forms part of a housing body.

3. A safety switch assembly as claimed in claim 1 in which there are a plurality of pairs of first contacts and a plurality of pairs of second contacts.

4. A safety switch assembly as claimed in claim 1 in which there are at least one pair of first contacts and at least one pair of second contacts.

5. A safety switch assembly as claimed in claim 4 in which first and second contacts or the at least one pair of first contacts are spaced radially.

6. A safety switch assembly as claimed in claim 4 in which first and second contacts of the at least one pair of first contacts are spaced circumferentially.

7. A safety switch assembly as claimed in claim 6 in which first and second contacts of the at least one pairs of first contacts are spaced diametrically opposite one another in a common pitch circle diameter.

8. A safety switch assembly as claimed in claim 4 in which the at least one pair of second contacts forms a conduction path between the at least one pair of first contacts in the power ON position.

9. A safety switch assembly as claimed in claim 1 in which the first contacts connect with electrical terminals by way of conduction paths.

10. A safety switch assembly as claimed in claim 9 in which the terminals are configured to accept wire connections.

11. A safety switch assembly as claimed in claim 9 in which the terminals form electrical connection pins to receive a mating socket.

12. A safety switch assembly as claimed in claim 11 in which a plurality of first contacts are provided, and in which a corresponding plurality of pins take the form of a plug which receives a correspondingly configured socket.

13. A safety switch assembly as claimed in claim 1 in which the first contacts are disposed concentrically to one side of the housing part.

14. A safety switch assembly as claimed in claim 1 in which the housing part comprises a web or flange and there first contacts are disposed to both sides of said web and wherein the rotary member comprises two parts disposed to opposite sides of said web and presenting the second contacts to make and break engagement with said first contacts.

15. A safety switch assembly as claimed in claim 1 in which the rotary member comprises two separately rotatable rotary members.

16. A safety switch assembly as claimed in claim 15 in which there is a respective locking member for each of the rotary members.

17. A safety switch assembly as claimed in claim 16 in which each locking member is urged into locking engagement with a respective rotary member by resilient biasing means.

18. A safety switch assembly as claimed in claim 1 in which the rotary member comprises two members that are connected to rotate together.

19. A safety switch assembly as claimed in claim 1 in which the first contacts comprise conduction paths that are integrated into a non-conductive material forming at least a part of the housing.

20. A safety switch assembly as claimed in claim 19 in which the conduction paths lead between exposed contact areas and a terminal including at least one of a plurality of pin connections, a socket, and wire terminal blocks.

21. A safety switch assembly as claimed in claim 19 in which the conduction paths are embedded conductors.

22. A safety switch assembly as claimed in claim 1 in which the second contacts comprise contact elements that are biased towards the first contacts.

23. A safety switch assembly as claimed in claim 22 in which at least the second contacts may comprise strips of conductive material that exhibit resilience.

24. A safety switch assembly as claimed in claim 23 in which the second contacts comprise cantilevered strips.

25. A safety switch assembly as claimed in claim 1 in which the second contacts carried by the rotary member are resiliently biased towards the first contacts.

26. A safety switch assembly as claimed in claim 1 in which the first contacts are resiliently connected to respective conductor paths leading through the housing.

27. A safety switch assembly as claimed in claim 1 in which the housing has at least one aperture to receive the actuator for the rotary member, and the rotary member has at least one reception location in which an end of the actuator engages to rotate the rotary member in response to movement of the actuator.

28. A safety switch assembly as claimed in claim 27 in which the housing has two apertures that are disposed perpendicularly to one another and the rotary member is provided with reception locations to permit rotation thereof on entry of the actuator through either one of the apertures.

29. A safety switch assembly as claimed in claim 28 in which the apertures are formed in a housing cap that attaches to the housing body.

30. A safety switch assembly as claimed in claim 28 in which the apertures are disposed offset from the axis of rotation of the rotary member and wherein a housing cap may be attached to the housing body in alternative orientations to create a further two positions in which the actuator can be inserted relative to the rotary member, and the rotary member has reception locations to accept the actuator in said alternative positions.

31. A safety switch assembly as claimed in claim 1 in which the housing accommodates at least one locking member which is movable between a first position in which rotation of the rotary member is prevented and a second position in which rotation is permitted.

32. A safety switch assembly as claimed in claim 31 in which the at least one locking member comprises a lug that is received in a recess of the rotary member in the first position.

33. A safety switch assembly as claimed in claims 31 in which the actuator is configured to displace the at least one locking member from the first position on insertion of the actuator in to at least one aperture formed in the housing.

34. A safety switch assembly as claimed in claim 31 in which the at least one locking member is slidably or pivotably movable.

35. A safety switch assembly as claimed in claim 31 in which the rotary member is rotatable against resilient biasing which acts to return the rotary member to a first position, when the actuator is removed.

36. A safety switch assembly as claimed in claim 31 in which the rotary member is urged into sealing contact with the housing part carrying the first stationary contacts to seal the contacts from the environment.

* * * * *